US006868619B1

(12) United States Patent
Boren et al.

(10) Patent No.: US 6,868,619 B1
(45) Date of Patent: Mar. 22, 2005

(54) TENNIS NET CENTER STRAP FOR MEASURING AND HOLDING NET AT CERTAIN HEIGHT

(76) Inventors: Mark Edelman Boren, 318 Forest Hills Dr., Wilmington, NC (US) 28403; Lawrence Christopher Williams, 208 Macon Smith Dr., Willard, NC (US) 28478

( * ) Notice: Subject to any disclaimer, the term of this patent is extended or adjusted under 35 U.S.C. 154(b) by 0 days.

(21) Appl. No.: 10/705,035

(22) Filed: Nov. 10, 2003

(51) Int. Cl.[7] ..... G01B 3/10; A63B 61/04

(52) U.S. Cl. ..... 33/760; 33/758; 33/759; 473/495; 24/306

(58) Field of Search ..... 33/755, 758, 759, 33/760; 24/165, 182, 300–302, 306, 442; 116/222; 473/490, 493–495; 273/317.4, DIG. 30

(56) References Cited

U.S. PATENT DOCUMENTS 1,239,924 A * 9/1917 Lord ..... 473/492
1,351,066 A * 6/1920 Robinson ..... 473/495
1,409,981 A * 3/1922 Vaile ..... 473/495
1,534,447 A * 4/1925 Hardy ..... 473/495
3,549,146 A * 12/1970 Davis ..... 473/494
4,247,099 A * 1/1981 Pandak ..... 33/755
4,671,509 A * 6/1987 Newman ..... 473/495
4,973,055 A * 11/1990 Muir ..... 473/495
5,393,051 A * 2/1995 Merino et al. ..... 473/494
6,449,815 B1 * 9/2002 Spiller ..... 24/306
2003/0014878 A1 * 1/2003 Smith ..... 33/759

* cited by examiner

*Primary Examiner*—G. Bradley Bennett

(57) ABSTRACT

A tennis net strap that both measures and holds center of tennis net at regulation height above court is described. Strap is of minimally stretching material and employs cam buckle with preferably a short secondary strap with hook-and-loop material as back up security measure. On opposite end of strap from buckle, a metal tab keeps strap end clean and from fraying. A single-end snap clip anchors strap to court. A primary measuring mark is located on strap near tab, which is aligned with slot in cam buckle to ensure strap is fastened at correct length. With cam buckle closed, strap is rotated until secondary mark on strap 36 inches from end of metal tab aligns with top of net, with tab just touching court surface. A third security measure is preferably employed in which now aligned areas on both sides of installed strap are fastened together through net.

4 Claims, 4 Drawing Sheets

TENNIS NET CENTER STRAP FOR MEASURING AND HOLDING NET AT CERTAIN HEIGHT

CROSS REFERENCE TO RELATED APPLICATIONS

Not Applicable.

STATEMENT REGARDING FEDERALLY SPONSORED RESEARCH OR DEVELOPMENT

Not applicable.

REFERENCE TO SEQUENCE LISTING, A TABLE, OR A COMPUTER PROGRAM LISTING COMPACT DISK APPENDIX

Not applicable.

BACKGROUND OF THE INVENTION

The present invention is a part of tennis net equipment generally, and specifically relates to permanent and portable devices and straps for adjusting and maintaining the regulation height of a tennis net.

| | |
|---|---|
| Current U.S. Class: | 473/495; 24/625 |
| Intern'l Class: | A63B 061/00 |
| Field of Search | 273/29 BA 24/627,628,629,630,631,632,634,635, 636 |

References cited:
U.S. patent documents:

| | | | |
|---|---|---|---|
| 1239924 | September 1917 | Lord | 273/29. |
| 1351066 | August 1920 | Robinson | 273/29. |
| 1409981 | March 1920 | Vaile | 273/29. |
| 1534447 | April 1925 | Hardy | 273/29. |
| 3549146 | December 1970 | Davis | 273/29. |
| 4247099 | January 1981 | Pandak | 273/29. |
| 4671509 | June 1987 | Newmann | 273/29. |
| 4831694 | May 1989 | Kong | 24/635. |
| 4973055 | November 1990 | Muir | 273/29. |

Foreign Patent Documents:

| | | | |
|---|---|---|---|
| 190006 | December 1922 | GB | 273/29. |
| 344615 | March 1931 | GB | 273/29. |
| 516402 | January 1940 | GB | 273/29. |
| 2138879 | October 1984 | GB | 24/634. |

A vertical net suspended by a metal cable bisects a tennis court into two equal playing areas. The net and cable are connected to posts that are taller than the regulation height stipulated for the center of the net (currently 36 inches). In preparing the court for play, the cable is pulled taut between the two posts and then a net strap adjusts the center of the net downward to regulation height and attempts to hold it there. The maintenance of the net at the prescribed height is crucial for fair play, with the slightest variance potentially having a profound impact on the scoring and outcome of a given tennis match. Serious players often carry tape measures to matches with them and spend a great amount of time—both prior to and during play—trying to adjust extant net straps to bring the net to the correct height. In professional matches, the net height is checked periodically during a match.

Many forms of net strap exist and a number of different devices have been proposed to correctly measure and maintain a tennis net at the correct height. Muir (U.S. Pat. No. 4,973,055) describes a net strap with an integral measuring system in which two pieces of strapping material are fastened to the court anchor by a double-ended snap hook. One of the straps has a serrated-edge buckle, through which the other strap is fed before it is folded down upon itself and attached to itself by means of hook and loop material. A sliding, interwoven measuring tape device is integral to the net strap and is adequate for measuring the net to the correct height; however, the strap itself does not maintain the net at the correct height over moderate to long periods of time. The buckle system does not sufficiently hold, and the serrated edge in the buckle actively degrades the strap material. Also, the sliding, interwoven measuring tape has a "different look" to it that can be distracting, especially in a professional context.

Pandak (U.S. Pat. No. 4,247,099) offers another net strap with an integral measuring device comprising a single strap passed through a snap hook with a set of interlocking rings or a Velcro fastener close to each end. The strap is passed over the net and the ends secured and the net is at the correct height when one end of the strap touches the ground and an indicator mark is visible on the top of the net. This simple device correctly measures the net height while the strap is new, but the device has two major problems. The free (measuring) end of the strap can abrade and become frayed during match play (thus negating its usefulness in measuring the correct height of the net), and neither the rings nor the Velcro sufficiently holds the strap in place (balls hitting the net loosen the Velcro and cause ring slippage, and dirt, sun, and rain rapidly deteriorate both fasteners' holding ability).

Newman (U.S. Pat. No. 4,671,509) describes a net strap very similar in design to Muir (U.S. Pat. No. 4,973,055), although without the measuring device. Newman's strap is a single piece of material that is joined with a serrated buckle on one end. The other end is fed through the buckle and folded back onto itself where it is attached with a hook and loop material. Unlike Muir's device, however, a sliding snap hook is used for connecting the strap to the court surface, making removal of the strap a tedious process, whereas Muir's can just unclip from the court by disengaging one strap from the double-ended snap clip. The abrasion problems with Muir's serrated buckle occur here as well, though in an even more exacerbated fashion. And this device mandates an exterior measuring device, such as a tape measure or a yardstick be employed. The height of the net must be measured each time it is checked.

Robinson (U.S. Pat. No. 1,351,066) describes a net strap that is limited in use to courts other than hard courts (the majority of courts in the U.S. are hard courts), because it demands an anchoring peg and chain be driven into the court surface. Although once installed (this takes measuring with an exterior measuring device) it remains at the correct height, the strap forces the destruction of existing regulation court anchors (the standard of which are designed to accept a snap clip).

Hardy (U.S. Pat. No. 1,534,447) describes a strap and buckle for holding a tennis net to a prescribed height, but it has no integral measuring system or secondary security systems to prevent slippage.

Vaile (U.S. Pat. No. 1,409,981) describes a center stay for a tennis net which holds the net at 36 inches above the court provided that the court anchor depth never changes from that to which his stay was measured; his device does not allow for what are common deviations in court anchor depths.

Davis (U.S. Pat. No. 3,549,146) shows a measuring device attached to a tennis net strap anchor, but like Robinson, this device must be driven into the court surface (thus it can't be used on hard courts) and cannot be adapted to use the anchors already available on most hard and soft courts.

This self-measuring tennis net strap is unique in many ways and overcomes the problems associated with prior net strap inventions. It is adaptable to different court surfaces and anchor configurations and depths. It is easy to install and adjustable. The cam buckle and primary measuring mark allows for extremely rapid installation and initial adjustment, and the secondary mark confirms the net is set at the right height. The steel tab on the free end of the strap keeps the end from fraying and ensures that the secondary measuring system will work consistently. Should a gross variation occur in the depth of the court anchor, the secondary measuring mark will make for the proper allowance and set the net at the correct height. No other net strap has two effective measuring systems.

This self-measuring tennis net strap also conforms to "traditional" net strap appearances and offers no distraction to players, at the same time that it allows for a player to immediately check to see that the net is indeed maintained at the right height. This strap is extremely durable, with a non-slipping, non-abrading cam buckle, preferably reinforced by two other fastening systems, in order to effect a heavy-duty strap that can withstand high-level play and hard use over long periods of time.

BRIEF SUMMARY OF THE INVENTION

The object of the invention is to provide a durable, self-measuring tennis net strap and fastening system that quickly installs, measures, and securely holds the center of a tennis net at a certain (regulation) height above a variety of court surfaces. To achieve this the self-measuring tennis net strap is made of minimally or non-stretching material and employs a universal snap clip and a non-slipping cam buckle, which preferably has a short, secondary strap with a hook and loop material as a secondary security measure. A third hook-and-loop securing system is also preferably employed as well. The first measuring mark makes installation and initial measuring extremely fast and easy, while the second measuring mark affirms the net is at the right height, and if necessary serves to give the correct height when there is extreme variation in court surface anchors.

The strap of non- or minimally stretching material, such as polyester or Kevlar webbing, is fastened to the center anchor in the surface of a tennis court by means of a single-ended snap clip with a slot through which the strap can slide. A cam buckle is sewn to one end of the strap and a metal tab affixed to the other. The tab end is pulled up one side of the net, brought over the top of the net, and inserted through the cam buckle until a primary measuring mark crossing the strap near the tab end of the strap appears at a certain place in the cam buckle, preferably within a slot.

A back-up measuring mark for checking the proper height of net crosses the strap at such a distance that with the cam buckle closed, the mark is level with the top of the net when the strap is rotated through the anchoring snap clip until the tab end of the strap just touches the playing surface. Preferably a second, shorter strap is included that acts as a backup security fastening system once the cam buckle is closed. Attached to the underside of the cam buckle, this secondary strap is brought upwards to be secured with matching hook and loop materials against the underside of the main strap heading down into the closed cam buckle. Preferably, a third security fastening system made of mating swatches of hook and loop material is placed equidistant from the backup measuring mark, but on the underside of the main strap and thus opposite one another with the net strap properly installed. These are fastened to one another through the holes in the net to further secure net strap from slippage and, importantly, to maintain the strap in such a place as to keep the primary and secondary measuring marks clearly visible to those wanting to immediately know the proper net height has been maintained by the strap.

This net strap solves the above stated problems of prior net straps as it adapts to any height of court surface anchor and is usable above any court surface. It is easy to install, has an integral regulation height-measuring device, and is portable. It can be installed very quickly because it has a unique primary measuring mark at the buckle, thus avoiding the physical awkwardness associated with prior self-measuring straps, such as trying to adjust a strap while kneeling on the court surface and shortening or lengthening the strap at the same time that the user tries to hold one end of the strap or measuring device to the court surface while watching for an indicator mark to align with the top of the net. With this net strap, one can simply pull the strap through the buckle until a line appears at the buckle and snap the buckle closed—all while comfortably standing next to the net—rather than kneeling or bending over and trying to watch both the top and the bottom of the net at the same time one is adjusting a buckle somewhere between that 36-inch difference.

The cam buckle fastener does not deteriorate the strap and, with the reinforcement of two back-up hook-and-loop fastening elements, does not slip, thus maintaining the net at the set height for long periods of time. All previously adjustable straps slip under heavy or intense usage and do not hold over long periods of time. This net strap holds the net at the set height, through the preferable employment of three fastening systems (one cam buckle reinforced by two separate hook-and-loop fasteners)

Unlike previous self-measuring straps, this net strap also has two integral measuring systems: a primary measuring mark that is aligned with the cam buckle and a back-up measuring system, comprising a secondary mark on the strap that lets the height be checked immediately and allows for the anchor depth variance in its setting in the court surface, indicating the proper net height regardless. And an (optional) third indicator mark appears near the first mark on the cam buckle to further confirm the initial setting of the cam buckle occurs at the right spot. Finally, this net strap has a classic and traditional look and thus is not distracting to the players.

DETAILED DESCRIPTION OF THE INVENTION

Figure 1:
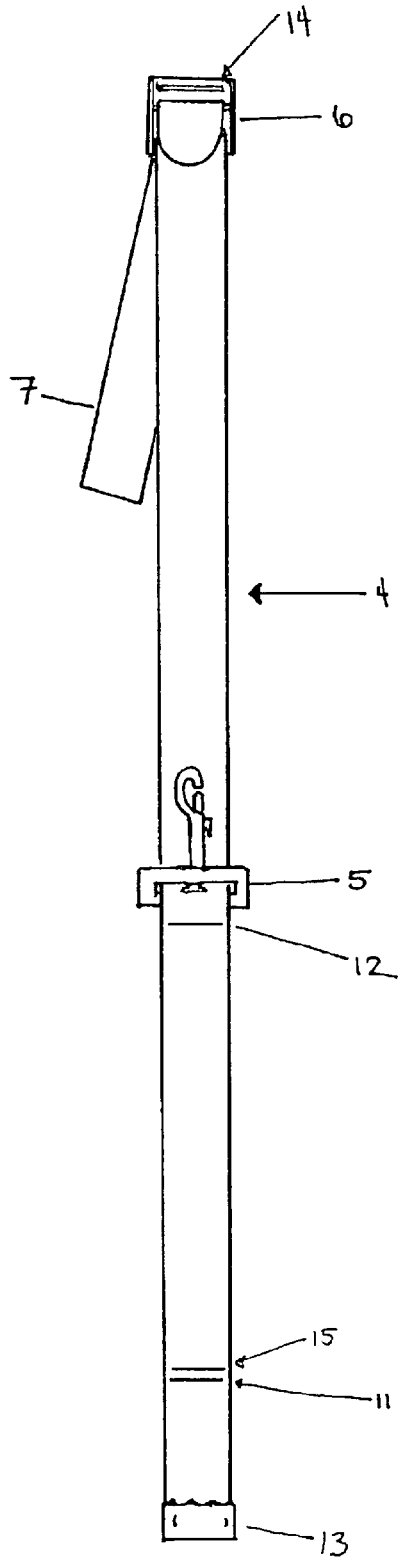
FIG. 1 is a representation of the net center strap laid flat prior to installation, showing cam buckle at top of page and metal tab at bottom; this view of the top of flattened strap (or outside of strap when installed) reveals the placement of the secondary security strap, the orientation of the sliding one-ended snap clip, the initial measuring mark, the backup mark and the preferred third mark.

A tennis net (1) is suspended between posts across a tennis court by a cable. The installed tennis net center strap (FIG. 4) adjusts and holds the center of the tennis net to regulation height (currently 36 inches) above the surface of the court (2) after being clipped to the center strap anchor (3) in the very center of the tennis court. To achieve this the self-measuring tennis net strap (4) is made of minimally or non-stretching material and employs a single-ended snap clip (5) and a non-slipping cam buckle (6) that preferably has a short, secondary strap (7) with one-half of a hook-and-loop material as a secondary security measure (8) that fastens to its mating one-half of hook and loop material (10) on the main strap (4). A third hook-and-loop securing system (9) is also preferably employed as well. The first measuring mark (11) makes installation and initial measuring extremely fast and easy, while the second measuring mark (12) affirms the net is at the right height, and, if necessary, serves to give the correct height even if there is extreme variation in court surface anchors.

The strap (4) of non- or minimally stretching material, such as polyester or Kevlar webbing, is fastened to the center anchor (3) in the surface of a given tennis court (2) by means of a metal (or durable material), single-ended snap clip (5) with a slot through which the strap (4) can slide. A metal (or plastic or nylon or other durable material) cam buckle (6) is sewn to one end of the strap and a metal tab (13) is affixed to the other. The tab (13) end is pulled up one side of the net (1), brought over the top of the net (1), and inserted through the cam buckle (6) until a primary measuring mark (11) crossing the strap near the tab end of the strap appears at a certain place, preferably within a slot (14), in the cam buckle (6).

Figure 2:
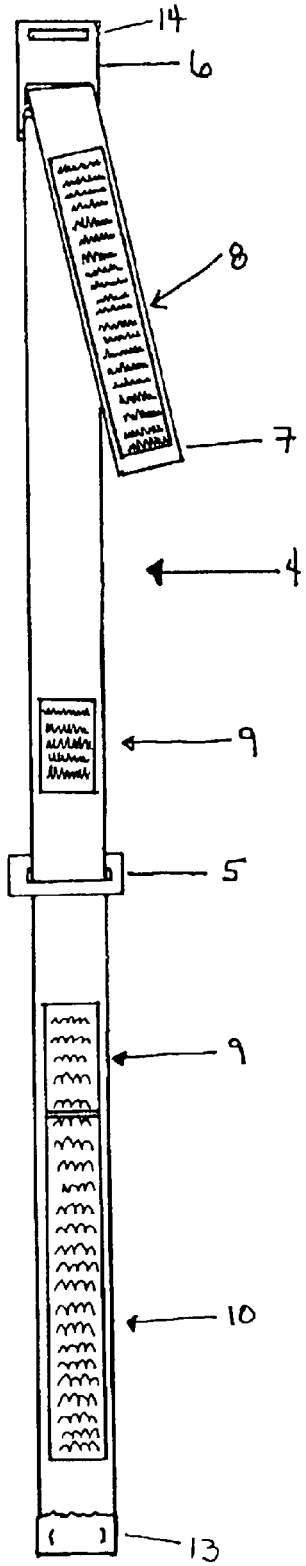
FIG. 2 is a representation of the net center strap laid flat prior to installation, showing cam buckle at top of page and metal tab at bottom; this view of the underneath of flattened strap (or inside of strap when installed) reveals the preferred secondary security strap with one-half of hook and loop fastening swatch, the orientation of the sliding one-ended snap clip, the placement of the matching one-half of the hook and loop on preferred secondary security strip, and the preferred third security swatches of hook and loop material.
Figure 3:
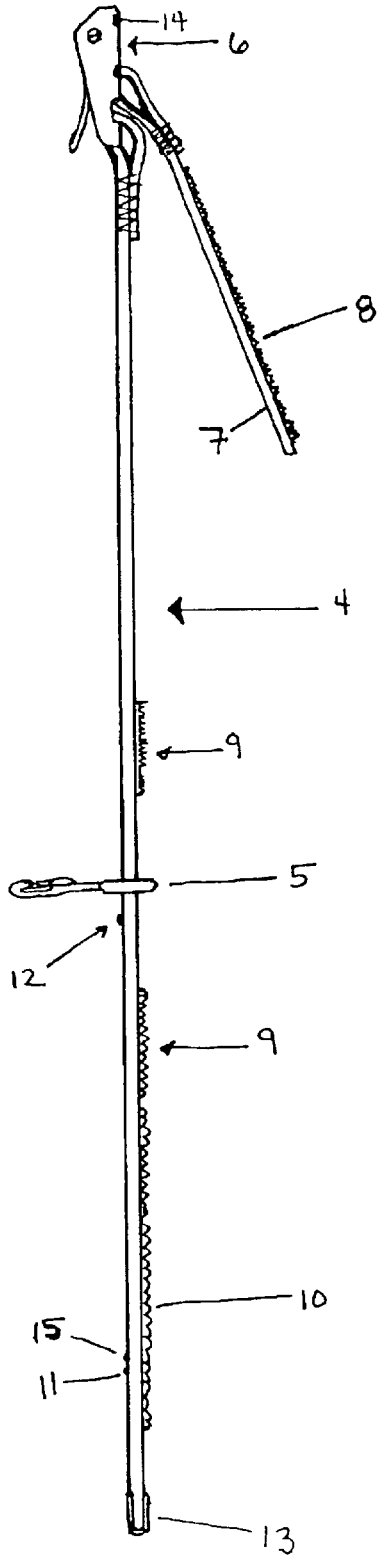
FIG. 3 is a representation of the side view of net center strap prior to installation, showing cam buckle at top of page and metal tab at bottom; this view of the side of flattened reveals the preferred secondary security strap with one-half of hook and loop fastening swatch, the orientation of the sliding one-ended snap clip, the placement of the matching one-half of the hook and loop on preferred secondary security strip, and the preferred third security swatches of hook and loop material.
Figure 4:
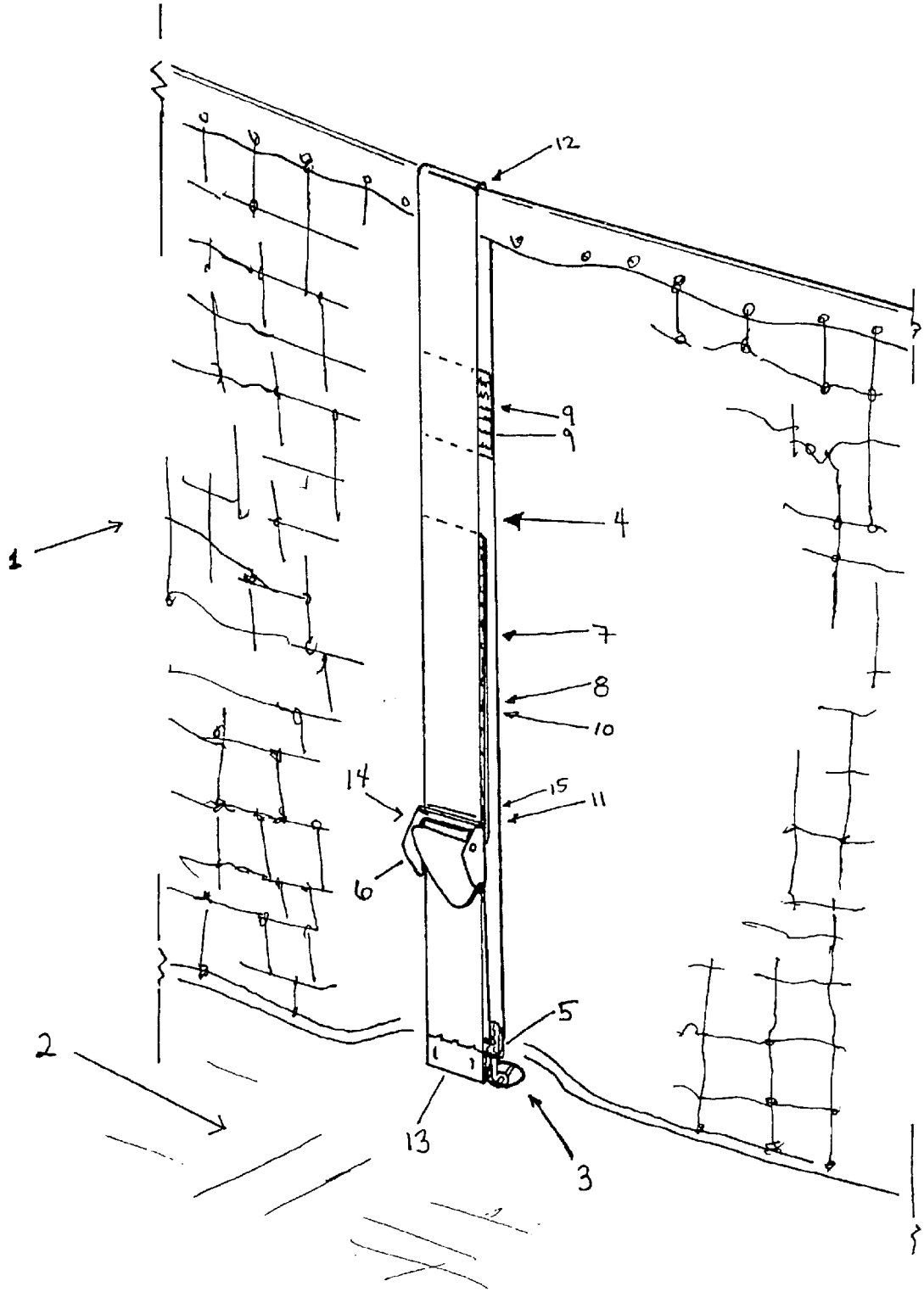
FIG. 4 is a perspective representation of the net center strap installed, with tennis net indicated by a partial drawing (net is artificially removed in drawing to see full strap); the cam buckle is closed with the initial measuring mark appearing in buckle slot and preferred third measuring mark appearing just above cam buckle; the preferred secondary security strip with hook and loop fastener has been pulled upwards and secured underneath main strap; the metal tab has been pulled to court surface, aligning secondary measuring mark with top of net; this view of installed strap shows the sliding one-ended snap clip snapped into court anchor, and the alignment of the preferred third security fastening swatches of hook and loop material.

The backup measuring mark (12) for checking the proper height of net crosses the strap (4) at such a distance that with the cam buckle closed, the mark (12) is level with the top of the net when the strap is rotated through the anchoring snap clip (5) until the tab (13) end of the strap (4) just touches the playing surface (2). Preferably a second, shorter strap (7) is included that acts as a backup security fastening system once the cam buckle (6) is closed. Permanently attached to the underside of the cam buckle (6), this secondary strap (7) is brought upwards to be secured with matching hook and loop materials (8,10) against the underside of the main strap (4) heading down into the closed cam buckle (6). Preferably, a third security fastening system (9) made of mating swatches of hook and loop material (9) is placed equidistant from the backup measuring mark (12) on the underside (FIG. 2) of the main strap (4) to appear directly opposite one another with the net strap properly installed (FIG. 4). These opposing swatches (9) are fastened to one another through the holes in the net (1) to further secure net strap (4) from slippage and, importantly, to maintain the strap (4) in such a place as to keep the primary (11) and secondary (12) measuring marks clearly visible to those wanting to immediately know the proper net height has been maintained by the strap.

The strap (4) may also have a third measuring mark (15) on it that becomes visible when cam buckle is properly closed and thus indicates net is initially set at correct height.

It should be noted that the strap (4) width is between one-half and two and one-half inches wide, but preferably is two inches wide, and that the strap (4) may be in any color, although white or natural is preferred. The cam buckle may be metal, plastic, nylon, or some other durable material, and can be in a variety of colors, though one that matches or complements the strap color is preferred. The overall length of strap (4) including cam buckle is between 72 and 110 inches in length. The shorter strap (7) should be the same width or narrower that main strap (4) and is between 3 and 72 inches in length. The hook-and-loop swatch (8) sewn to or glued onto the secondary strap (7) is between 3 and 72 inches in length, as is its mating hook-and-loop swatch (10) adhered to the main strap (4). The secondary back-up security system, comprising swatches of hook-and-loop material (9) sewn or glued to strap (4) can be from one to 18 inches in length. The sliding snap clip (5) must have a slot wide enough to allow the strap (4) to pass through it. The primary measuring mark (11) and the third measuring mark (15) may vary in placement on the strap (4) relative to the overall length of the strap (4) and the size and manufacture of the cam buckle (6) employed, but can be determined in any case once the completed (except for these marks) strap (4) is installed on a test net (1). The secondary measuring mark (12) should measure net height regulation distance (currently 36 inches) from end of strap tab (13).

We claim:

1. A self-measuring tennis net center strap that quickly sets and secures the top of the center of a tennis net at a certain (regulation) playing height (currently 36 inches) above the playing surface comprising:

a strap of non- or minimally stretching material fastened to the center anchor in the surface of a tennis court by means of a single-ended snap clip with a slot through which the strap can slide, with a cam buckle sewn to one end of the strap and a metal tab affixed to the other, so that the tab end can be pulled up one side of the net, brought over the top of the net, and inserted through said cam buckle until a primary measuring mark crossing the strap near the tab end of the strap appears at a certain place in said cam buckle;

and with a back-up measuring mark for checking proper height of net crossing the strap at such a distance that with the cam buckle closed the mark is level with the top of the net when the strap is rotated through the snap clip until the tab end of the strap just touches the playing surface;

and preferably with a second, shorter strap that acts as a backup security fastening system when attached to the underside of the cam buckle—this secondary strap which is brought upwards to be secured with matching hook and loop materials against the underside of the main strap heading down into the closed cam buckle;

and preferably with a third security fastening system made of mating swatches of hook and loop material placed equidistant from the backup measuring mark but on the underside of the main strap so that they are opposite and facing one another with the net strap properly installed and which are fastened to one another through the holes in the net to further secure net strap from slippage and, importantly, to maintain the strap in such a place as to keep the primary and secondary measuring marks clearly visible to those wanting to immediately know proper net height has been maintained.

2. The tennis net center strap of claim 1 in which the primary measuring mark crossing the strap near the tab end of the strap appears at a certain place in said cam buckle, the exact point at which may vary between 0 and 35 inches, but which is determined by the location of where the said certain place on closed cam buckle falls on the installed strap, in relation to the overall length of the strap, factoring in the length of the single-ended snap clip with slot and the relative length of installed strap needed to bring the adjusted net to regulation height.

3. The tennis net center strap of claim 1 in which a third indicator mark is placed just above the initial measure mark that aligns with cam buckle slot so that when cam buckle is closed the first indicator mark disappears and the second appears in another area of cam buckle.

4. The tennis net center strap of claim 3 in which the first indicator mark is colored red (indicating user pulls net through cam buckle and stops when red mark appears in slot) and in which the third indicator mark placed just above first mark is colored green (indicating strap is set properly and user can go ahead and finish setting strap in order to play).

* * * * *